US008205553B2

(12) United States Patent
Benz et al.

(10) Patent No.: US 8,205,553 B2
(45) Date of Patent: Jun. 26, 2012

(54) PRINTING PRESS AND METHOD OF OPERATING A PRINTING PRESS, AND PRINTING PRESS SYSTEM AND METHOD OF OPERATING THE PRINTING PRESS SYSTEM

(75) Inventors: Peter Anastasius Benz, Goldach (CH); Günther Oskar Eckert, Zellingen (DE); Bernd Kurt Masuch, Kürnach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 651 days.

(21) Appl. No.: 12/379,744

(22) Filed: Feb. 27, 2009

(65) Prior Publication Data

US 2009/0223393 A1 Sep. 10, 2009

(30) Foreign Application Priority Data

Mar. 5, 2008 (DE) ..... 10 2008 002 793
Jun. 19, 2008 (DE) ..... 10 2008 002 529

(51) Int. Cl.
*B41L 35/14* (2006.01)

(52) U.S. Cl. ..... 101/488; 101/178

(58) Field of Classification Search ..... 101/488
See application file for complete search history.

(56) References Cited

U.S. PATENT DOCUMENTS

| | | | | |
|---|---|---|---|---|
| 1,774,119 | A * | 8/1930 | Waller | 101/152 |
| 5,117,753 | A * | 6/1992 | Mamberer | 101/225 |
| 5,152,222 | A * | 10/1992 | Okamura et al. | 101/211 |
| 6,374,731 | B1 * | 4/2002 | Walczak et al. | 101/142 |
| 7,004,070 | B2 | 2/2006 | Schneider et al. | |
| 7,549,327 | B2 * | 6/2009 | Breed | 73/146 |
| 7,591,224 | B2 * | 9/2009 | Bock et al. | 101/488 |
| 7,926,421 | B2 * | 4/2011 | Eckert | 101/424.1 |
| 8,001,891 | B2 * | 8/2011 | Eckert et al. | 101/221 |
| 2004/0103809 | A1 * | 6/2004 | Wiese | 101/483 |
| 2007/0101881 | A1 * | 5/2007 | Bitzl et al. | 101/228 |

FOREIGN PATENT DOCUMENTS

| | | | |
|---|---|---|---|
| DE | 20 2005 020 947 | U1 | 11/2006 |
| DE | 10 2005 039 073 | A1 | 3/2007 |
| DE | 10 2006 038 638 | A1 | 6/2007 |
| WO | WO 03/045694 | A1 | 6/2003 |
| WO | WO 2007/020288 | A1 | 2/2007 |
| WO | WO 2007/071459 | A1 | 6/2007 |

* cited by examiner

*Primary Examiner* — Anthony Nguyen
(74) *Attorney, Agent, or Firm* — Mattingly & Malur, P.C.

(57) ABSTRACT

A printing press is comprised of at least one dry offset printing unit. At least two different webs can be fed through the dry offset printing unit. In a first production mode "C" of the printing press, a first web is fed through the dry offset printing unit without a subsequent drying process. In a second production mode "H" of the printing press, a second web is fed through the dry offset printing unit and through an active dryer. In both the first and second production modes "C", "H", an inking unit of the printing unit is filled with the same ink.

19 Claims, 8 Drawing Sheets

PRINTING PRESS AND METHOD OF OPERATING A PRINTING PRESS, AND PRINTING PRESS SYSTEM AND METHOD OF OPERATING THE PRINTING PRESS SYSTEM

FIELD OF THE INVENTION

The present invention is directed to a printing press and to a method of operating a printing press, as well as to a printing press system and to a method of operating the printing press system. The printing press has at least one dry offset printing unit and prints selectively on at least two different webs which can each be fed through the dry offset printing unit. A dryer is available and at least one of the webs can be fed through the dryer after passing through the dry offset printing unit.

BACKGROUND OF THE INVENTION

In wet offset printing, problems frequently arise as a result of the difference in the amount of water retained in non-dried webs as compared with the amount of water retained in dried webs, and as a result of the different print materials, and especially as a result of the printing inks. In wet offset printing, the print substrate absorbs water nearly continuously following its initial contact with the dampening agent in the first printing couple. This continues until the layer of water that is applied to the surface of the paper during printing has been completely absorbed and then evaporated. Thus, in wet offset printing, the volume of the print substrate increases nearly continuously, while the modulus of elasticity decreases nearly continuously. As a result, the width of the paper web also increases nearly continuously. In printing, this is manifested as a so-called fan-out effect. The image portion that is printed with the first ink is wider, due to the effect of water on the paper, and the subsequent image segments must be made wider, by the same degree, in order to have the image printed with equal coverage, true to register. The decrease in the modulus of elasticity, which is caused by water absorption, results in increased lengthening of the web of paper, which is under tensile stress, and to a decrease in this tensile stress. For an average newsprint paper, and for a tensile stress level of 20 dAN/m, for example; a linear expansion of the web, of approximately 0.04%, occurs when the web is dry, for example, and a linear expansion of the web, of approximately 0.20%, occurs when the web is wet, after it leaves the printing unit, for example.

During passage through a dryer, the absorbed water in the web is practically completely evaporated, and the drying web of paper shrinks correspondingly, while the modulus of elasticity increases again. In hybrid production in wet offset presses, these effects can lead to problems with web lead and register.

A printing press system for producing coldset/heatset hybrid products is known from WO 2007/020288 A1. Different types of paper and different inks are used for coldset and heatset production.

DE 20 2005 020947 U1 discloses planar blanket-to-blanket printing units with printing couple cylinders that are mounted in linear bearings and which can be adjusted using power controls. For different paper qualities, different levels of pressure, for engaging the print-on setting, are provided.

In the disclosure of WO 03/045694 A1, it is recommended that an ink having a tack of 6 to 9.5, as measured using an Inkomat device manufactured by the Prüfbau company, should be used for dry offset printing in the printing couple under pressure conditions.

DE 10 2006 038 638 A1, WO 2007/071459 A1 and DE 10 2006 038 638 A1 each disclose, among other things, a "heatset printing unit," which can be operated in one production mode using heatset ink and which can be operated in another production mode using coldset ink. Heatset and coldset inks are defined as inks having different properties and compositions.

SUMMARY OF THE INVENTION

The object of the present invention is to provide a variable printing press that is also easy to operate, and to provide a printing press system that is capable of producing a particularly broad spectrum of products and which is also easy to operate.

In accordance with the present invention, this object is attained by the provision of a printing press having at least one dry offset printing unit and being able to selectively print on at least two different webs which can both be fed through the dry offset printing unit. An active dryer is provided as part of the printing press. In a first production mode, a first web is printed in the dry offset printing unit without a subsequent drying process. In a second production mode, a second, different web is fed through the dry offset printing unit and through the dryer. In both production modes, the same ink is applied to the webs. Two separate printing units can also be provided.

The advantages to be gained by the present invention consist especially in that a printing press, and especially a newspaper printing press, can be used for more than simply newspaper production. In addition to newspaper production, the printing press can also be used to produce a multitude of other, different printed products. In order for such a printing press to cover the broadest possible spectrum of different printed products, it must also be capable of executing processes that will increase the quality of the resultant printed product. This includes, in particular, hot air drying. Printing couples that are intended for use in printing webs of print substrate, and especially in printing webs of paper, or webs, which will be dried with hot air after printing, must fulfill particular prerequisites for this purpose.

In mixed or hybrid printed products, it is advantageous if only a portion of the pages of the finished product, such as, for example, the cover pages and/or those in the inner panoramic positions, are required to be dried using hot air. In this case, a portion of the paper webs, and preferably only a single web, is fed through a dryer after it has been printed. The remaining paper webs are printed in coldset, for example, or in other words, are printed without drying, and are fed together with the dried paper web, or webs to the folding unit or units. To be able to employ hybrid presses efficiently, it is advantageous, for the printing units that are used with hot air drying, to also optionally be able to be operated using paper webs that do not require drying, with as rapid a change between webs as possible.

It is of particular advantage that dry offset presses, which are characterized by the absence of water absorption by the print substrate, have practically no web fan-out, and exhibit no significant change in the modulus of elasticity of the web after printing. The changes to the dimensions of the paper web, which are caused by the hot air drying process, are therefore also much less significant. For this reason, in dry offset presses the settings for the nip rollers for dry offset paper webs that are hot air dried do not differ, in practical terms, from the settings for paper webs that are not hot air dried. This makes the synchronous printing operation on dried and non-dried dry offset webs less problematic.

The dimensional stability of paper webs, which are printed in dry offset printing, is manifested in only slight differences between hot air dried and non-hot air dried paper webs in dry offset presses. This therefore permits hybrid applications that can also be used for wet offset presses, by using dry offset for the hybrid webs.

It is particularly advantageous for the dry offset press to use inks that have special, beneficial properties and/or to use special materials for the webs of print substrate. The same ink can be used for coldest printing and heatset printing, and in both cases, dampening agent can be eliminated. This enables the webs to be changed rapidly, especially in the case of hybrid webs, from heatset to coldset, and vice versa.

Another benefit of the present invention is the good web travel properties, which result from the dimensional stability of the print substrate, due to the elimination of the dampening water. This especially makes web transfer in heatset/coldset hybrid operation less critical.

The dimensional stability of the print substrate, resulting from the elimination of the dampening water, also enables an improved circumferential register. It also results especially in an improved lateral register.

Combining a platform configuration, or a floor assembly configuration of the coldset printing press, with an in-line configuration of the heatset printing press, allows a low structural height, even with a former assembly that has multiple levels.

Introducing the hybrid webs from the side of the printing unit allows these webs to be inserted into the product at any point in the product. This can be done without great expense and nearly without restrictions.

In one embodiment of the present invention, which is particularly advantageous in terms of the product thickness that can be produced, a triple-width printing press, which is capable of operating in heatset, is combined with a triple-width printing press that is operated in coldset, such that a heatset web can be transferred.

BRIEF DESCRIPTION OF THE DRAWINGS

Preferred embodiments of the present invention are represented in the set of drawings and will be specified in greater detail in what follows.

The drawings show in

DESCRIPTION OF THE PREFERRED EMBODIMENTS

Figure 1:
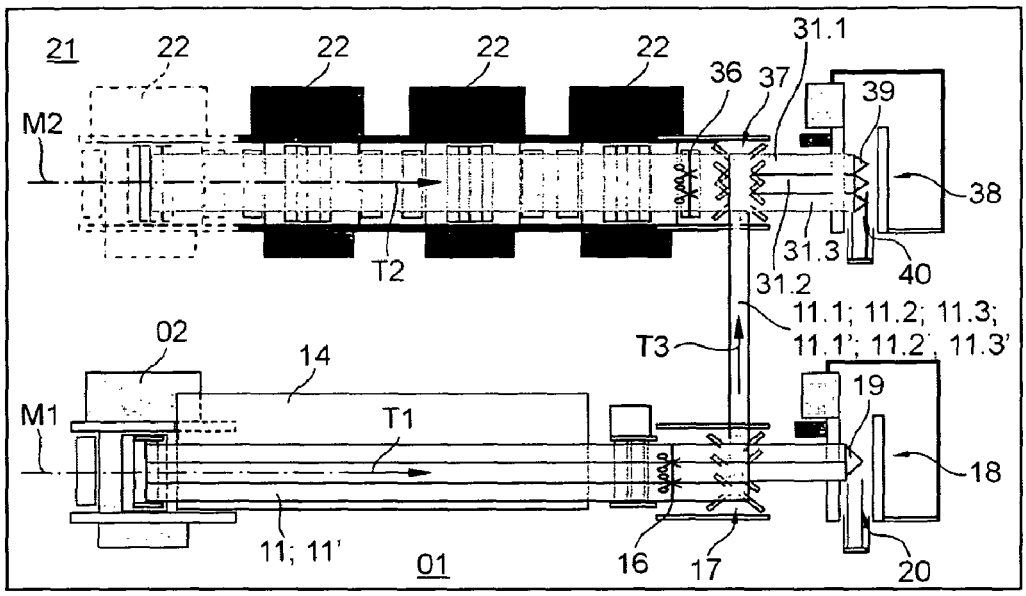
FIG. 1 a top plan view of a printing press system in accordance with the present invention.

Referring initially to FIG. 1, there may be seen a schematic top plan view of a printing press system in accordance with the present invention. In addition to there being provided one or more printing units 02 of a first type, or first printing units 02 in a first printing press 01, there are also provided one or more printing units 22 of a second type, or second printing units 22 in a second printing press 21. The first and second printing units 02; 22 can be aligned side by side or one behind another, but preferable are aligned side by side, for example parallel with, or angled in relation to one another, in a manner which will be specified in greater detail below.

The discussion which is set forth, with regard to the first printing press 01 or the first printing units 02, in terms of the optional production modes and/or in terms of the application of inks having special properties that enable such optional production modes, and/or the webs of print substrate, can also be applied, in its teaching, to a single printing press 01, independently of the presence of another printing press. The other printing press can be, for example, the above-mentioned second printing press 21, or one or more printing units 02 of the first type.

In one embodiment of the present invention, the two types of printing units 02; 22 can be fundamentally the same. In this embodiment, they can both operate using the same printing process, as will be set forth below and/or using the same applied printing technology and/or using imaging printing couple cylinders 04; 24 having the same dimensions, such as length and circumference, as also discussed below.

Advantages, with respect to product configuration, can be realized, however, if the two types of printing units 02; 22 are different from one another. These differences can be based upon anticipated printing requirements and the two types of printing units 02; 22 can thus fulfill such different printing requirements.

What is important here is that at least one of the two printing presses 01; 21, or at least one printing unit 02; 22 of one of the two types of printing units, is embodied as an offset printing unit 02; 22, in this case, the printing press 01 or at least one printing unit 02 of the first type, with offset printing couples, i.e., with printing couple cylinders 06; 26, such as, for example, with transfer cylinders 06; 26, and which can be operated using the offset printing process. Preferably, this printing press 01, or at least one printing unit 02 of this printing press 01, can be, or is operated using the dry offset process. The printing unit or units 02 of this first printing press 01, which can be operated using the dry offset process, is, or are embodied such that it, or they can be, or are operated without the addition of dampening agent. The printing couples of this first type of printing unit 02 are embodied without a dampening unit and have inking units 07, as may be seen in FIG. 3, and which, in one advantageous embodiment, are configured as so-called short inking units 07 comprising an anilox roller 08, for example. The anilox roller 08 is preferably embodied to be temperature controllable. The quantity of ink is, or can be adjusted, by controlling the temperature of the roller 08 and thereby the viscosity of the ink.

The printing unit 02 is supplied with web-type print substrate 11, or a web 11. The web 11 is provided by a roll changer 03 which is located upstream of printing unit 02.

The at least one printing unit 02 of the first type in the first printing press 01 is preferably embodied as a printing tower 02 with a substantially vertical web lead. It has a plurality of print positions 09, which are situated one above another, for double-sided multicolor printing, as is depicted schematically in FIG. 3. In principle, the printing tower, which forms the first type of printing unit 02, can be comprised of a plurality of stacked units, such as, for example, H-printing units or satellite printing units. However, it is advantageous for a plurality of blanket-to-blanket printing units, such as planar bridges, or n- or u-units, to be arranged one above another. The blanket-to-blanket printing units each have two printing couples, each with printing couple cylinders 04; 06, of which cylinder 04 is embodied as a forme cylinder and cylinder 06 is embodied as a transfer cylinder. The print position 09, that cooperates with a web 11; 11' to be printed, is formed between the two cooperating transfer cylinders 06 of each blanket-to-blanket printing unit. The blanket-to-blanket printing units can be arranged stacked one above another in a plurality of frames or, as shown here, in a single frame 12. In the present example, four, preferably planar, blanket-to-blanket printing units are arranged one above another in a shared side frame. The four printing couple cylinders 04; 06 in each printing unit are preferably arranged such that, when they are in the print-on position, their rotational axes lie substantially within a shared plane E1. This shared plane E1 is preferably inclined from 85° to 70° from vertical, as may be seen in FIG. 3.

Figure 3:
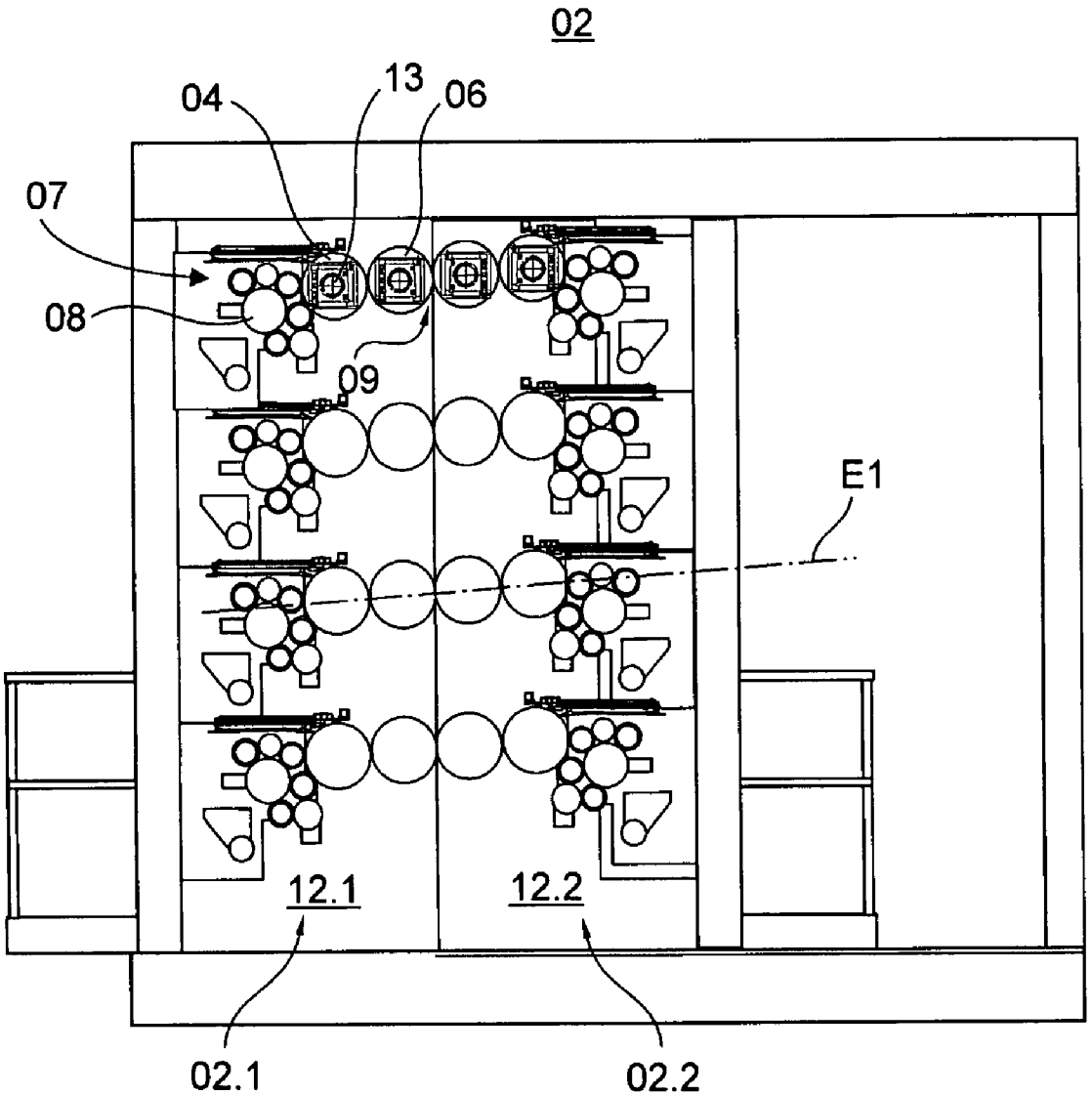
in FIG. 3 a schematic side elevation view of a printing unit of the first printing press.

In one advantageous preferred embodiment of the present invention, the printing couple cylinders 04; 06 are each mounted individually in bearings 13, such as, for example, in linear bearings 13, as shown schematically in FIG. 3 and can preferably each be adjusted via power controls. In this case, adjustment can be made via a definable pressure level. For different print substrates 11; 11' on the webs 11; 11' to be printed, such as, for example, different coating weights and/or roughness grades, different pressure levels can be preset, or are preset, for example by the use of suitable power controlled actuators. This creates the advantage that, for different production modes, such as, for example, coldset "C" and heatset "H" printing, different pressure levels, for adjusting the print-on position of the bearings 13, can be or are preset. Adjustable stops are then set, for example starting with a free stop, by engaging the cylinder that is to be adjusted against the other cylinder at the chosen pressure level. When the cylinder is in this position, the stop is placed and fixed against the bearing block, and during operation, in the print-on position, the cylinder presses, with an excess level of pressure, against the stop that was set previously using the desired level of pressure. The direction of adjustment of the linear bearings 13 preferably forms a maximum acute angle of 0° to 15° with the plane E1, in the case of a planar blanket-to-blanket printing unit.

In one advantageous embodiment of the first type of printing unit 02, that unit is configured to be functionally separable, such as, for example, for repair and maintenance purposes, as opposed to for purposes of disassembly or dismantlement. To this end, the printing couple cylinders 04; 06 of the plurality of blanket-to-blanket printing units, such as four such printing units, which are arranged one above another, are rotatably mounted in, or on, one right frame or panel section 12.2 and one left frame or panel section 12.1 in such a way that the two printing couple cylinders 04; 06 of a single printing unit are allocated to the same frame or panel section 12.1; 12.2, all as depicted in FIG. 3. The printing couple cylinders 04; 06 of a plurality of printing units, and especially of all of those printing units that print the web 11; 11' on the same side, are preferably mounted on the same frame or panel section 12.1; 12.2. The two parts that can be separated from one another are identified in FIG. 3 as partial printing units 02.1 and 02.2. The spacing of the partial printing units 02.1; 02.2 from one another can be adjusted along a direction perpendicular to the rotational axes of the printing couple cylinders 04; 06, especially in a horizontal direction. Preferably, one of the two frame or panel sections 12.1; 12.2 is stationarily mounted while the other is mounted so as to be movable in relation to the first.

The first type of printing press 01, which can be operated in dry offset mode, also has a corresponding apparatus for drying support 14, such as, for example, a dryer 14. It is possible for only one printing unit 02 of the first type and one dryer 14 to be arranged in a machine alignment M1, which machine alignment M1 extends perpendicular to the axial direction of the printing couple cylinders 04; 06 of the printing unit or units 02 of the first type, all as seen in FIG. 1. It is also possible, however, for several printing units 02 of the first type, arranged in the manner of a linear press, and for one or more dryers 14, such as, for example hot air, UV or IR dryers, and/or optionally other units, such as a cooling unit 15, such as, for example, chill roller stands, and/or optionally a varnishing unit, to be arranged in the machine alignment M1. Such an arrangement of one or more printing units 02 of this type, for example together with an additional dryer 14, as well as the other accompanying units, in a single machine alignment M1 can also be characterized, in the discussion which follows, as a press line, and in specific cases as a heatset press line. The web 11; 11' to be printed is fed to the printing unit 02 by the roll changer 03, for example as shown in FIG. 1, by a roller changer 03 that is arranged in the same machine alignment M1, for example on a base level, or by a roller changer that is offset laterally and which is aligned with the rotational axis of the roll, and parallel with the machine alignment M1. The machine alignment M1 of the first printing press 01 or the press line extends at the level of a plane of symmetry that divides the printing couple cylinders 04; 06 of the first printing unit 02 in half lengthwise, and which can also be characterized in this configuration as machine center alignment M1.

If the printing unit or units 02 are multiple-width in configuration, such as, for example, having a printing width of four or even six printed pages, for example vertical newspaper pages or horizontal tabloid pages, arranged side by side, a longitudinal cutting device 16, and, in any case, a turning device 17, are situated downstream of the dryer 14 in the web path, for example. The turning device 17 makes it possible, for example, to divert a web 11 or to divert partial webs 11.1; 11.2; 11.3 to the second printing press 21, and/or to shift partial webs 11.1; 11.2; 11.3 laterally, before they are fed to a fold former 19 of the first printing press 01. If the heatset press line will also be operated autonomously in a separate production mode "G" of the printing press system, then a former assembly 18, having one or more fold formers 19 and a folding unit 20, is also provided, also in machine alignment M1, for example. For an "n"-width printing unit 02, "n" turning bars, and preferably "n" pairs of turning bars, are advantageously provided in the turning device 17.

The former assembly 18 of the first printing press 01 represented here has only one former plane with only one fold former 19. In principle, "n" fold formers 19 can be arranged side by side in one former plane in an "n"-width printing press, with "n"-width printing couple cylinders, and/or two or three former planes can be arranged one above another, each with one or with "n" fold formers 19.

In one production mode "H" of this first printing press 01, the printing press 01 that can be operated in dry offset, or the first type of printing unit 02 that can be operated in dry offset, is operated using the heatset process. A web 11', that has been printed in the dry offset printing unit 02, is fed through the activated dryer 14. In another production mode "C" of this first printing press 01, the press is operated using the coldset process. A web 11, that has been printed in the dry offset printing unit 02, is fed either around the dryer 14 or through the now deactivated dryer 14. The printing press 01 that can be, or that is operated using the dry offset process, or the printing unit 02 that can be, or that is operated using the dry offset process, can be, or is operated optionally using the heatset process or the coldset process. The term "heatset" is understood not only as the drying of the web 11 via a thermal process, but, in contrast to "coldset," also as drying via other drying devices, such as by using UV or IR dryers.

In the "C" or "coldset" production mode, the printing press 01 that can be, or that is operated using the dry offset process, or the printing unit 02 that can be, or that is operated using the dry offset process, is loaded with "normal" newsprint paper, such as, for example, wherein the print substrate 11; 11' is uncoated or is only lightly coated paper having a maximum coating weight of 20 g/m$^2$, for example, preferably a maximum of 10 g/m$^2$, and particularly having a maximum of 5 g/m$^2$. Rather than uncoated or lightly coated paper, in the "C" "coldset" production mode, paper which is referred to as "improved newsprint paper" can also be used as the web of print substrate. In the coldset process, the paper has a maximum base weight of 65 g/m$^2$, for example, with uncoated newsprint paper having a maximum base weight of 50 g/m$^2$ or even 40 g/m$^2$. In the "C" "coldset" production mode, a web of print substrate 11 or a paper having a roughness according to Parker Print Surf (PPS) of more than 3.50 μm, and especially of more than 4.00 μm, is preferably used. The smoothness according to Bekk, in accordance with DIN53107, is advantageously less than 70.0 s, and especially is less than 60.0 s, for example, at least on the smoother side. This, when combined with the paper's porosity, allows the ink to absorb well into the paper. To improve coverage behavior, in one advantageous embodiment of the present invention, lightly coated or improved newsprint paper, for example having a base weight of 40, 65 g/m$^2$, as the web of print substrate 11; 11' is fed through the dry offset printing unit 02 and around the dryer 14, or is fed through the inactive dryer 14 in the "coldset" process.

In the "H" or "heatset" production mode, the printing press 01 that can be, or that is operated using the dry offset process, or the printing unit 02 that can be, or that is operated using the dry offset process, is loaded with a web of print substrate 11' which is comprised of satinized and/or of more heavily coated paper having a coating weight of more than 10 g/m$^2$, for example more than 15 or even more than 20 g/m$^2$. The paper can be of average or higher quality, having a base weight range of more than 40 g/m$^2$, for example being in a base weight range of 55-90 g/m$^2$, and especially being greater than 50 g/m$^2$. The smoothness factor, according to Bekk, is preferably at least 70.0 s, especially at least 100.0 s, at least on the smoother side.

In one advantageous embodiment, and advantageously in both production modes "C", "H" an ink is used during operation in the dry offset printing unit 02 or in the dry offset printing press 01, which at 25°, using temperature data with a ±0.5° C. margin of error for viscosity values, has a viscosity of at least 120 Pas, and preferably of at least 150 Pas. If a plurality of inks, such as, for example, a number "n", are allocated to the same side of the web 11; 11' to be printed, at least the mean of the values for the "n" inks, such as, for example, black, cyan, magenta, yellow, averaged from the points of measurement, should be at least 120 Pas, and especially should be at least 150 Pas. Preferably, however, each of the averaged values for the "n" inks should be at least 120 Pas, and especially should be at least 150 Pas. The viscosities of the "n" inks allocated to the same side of the web 11; 11' preferably deviate by a maximum of 20% of the minimum value, i.e., of 120 or 150 Pas, for example by a maximum of 24 or 30 Pas, from the mean value of the "n" inks, when the temperature of the printing couples is regulated, for example. The viscosity values indicated here are to be measured using a Physica device, such as the Physica UDS 200, in this case device number UM 200/028210003, manufactured by the Anton Paar Company, preferably under the recommended standard conditions. For example, sample quantity 0.1 cm$^3$, cone-and-plate principle, cone angle 1°, shear rate D=10 1/s, measuring interval 5 sec., i.e., 12 measurements/min, at a shear rate of 10 s$^{-1}$, and, for example, averaged at least from values from a period of at least 5 s, advantageously 10 s, preferably averaged from values for the 12 sequential measurements within the minute of measurement.

Figure 4:
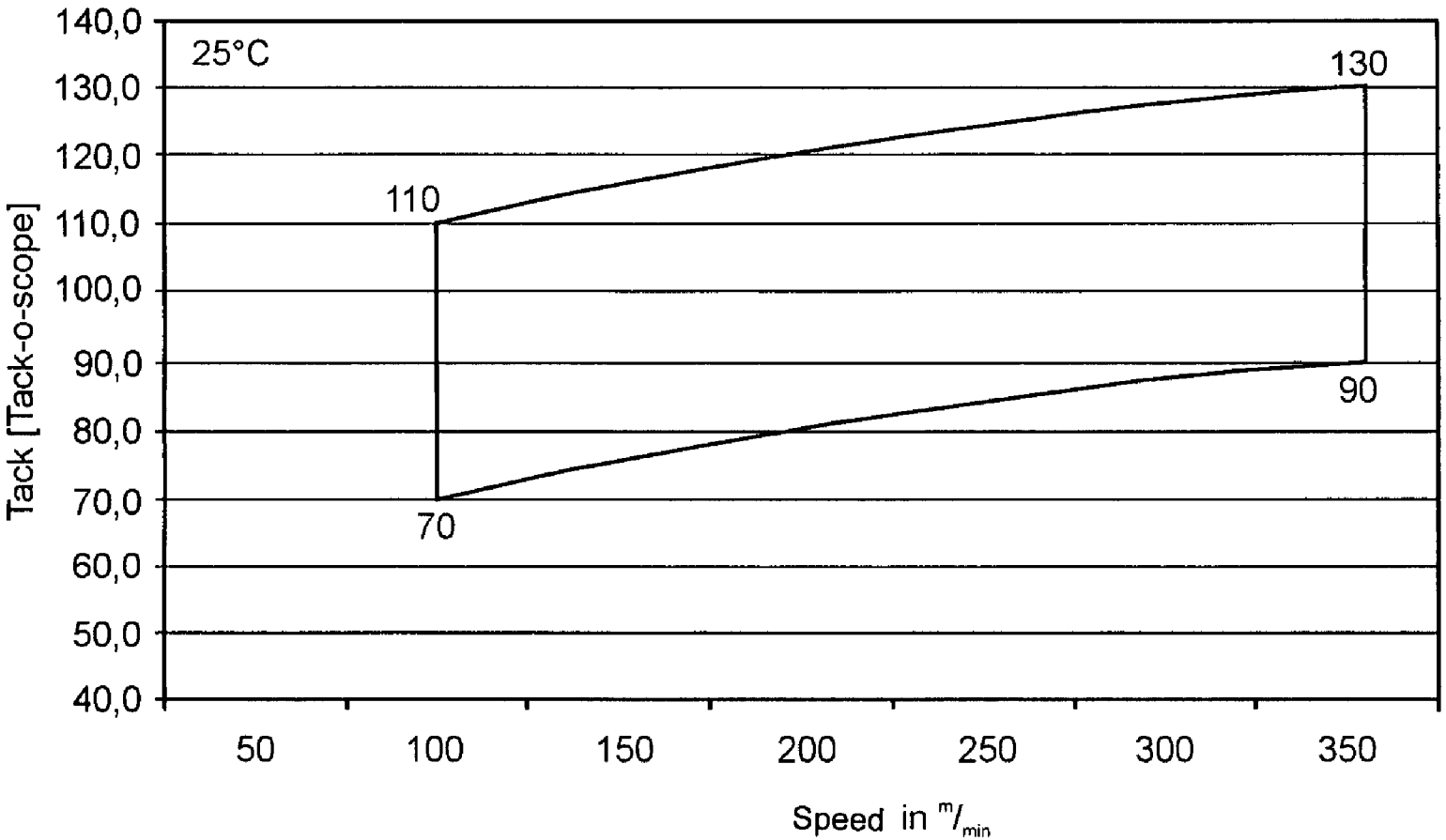
in FIG. 4 a tack range for an ink that can be used in coldset and heatset.

At a measuring temperature of 25°, with temperature data with a ±1° C. margin of error for tack values, and a speed of 350 m/min, temperature data with a ±2° C. margin of error for tack values, the maximum tack of an advantageous ink should be 130 tack, and especially should be 120 tack. This applies at least to a mean value of the measured values for the "n" inks to be applied to the same side of the same web 11; 11', but advantageously to all "n" inks, even viewed individually. FIG. 4 shows an example of an advantageous tack for an ink in relation to its dependence upon speed. Whereas the tack at 25° and a speed of 100 m/min should be approximately 90 tack±20 tack, in other words between 70 and 110 tack, at 25° and at a speed of 350 m/min, the tack is advantageously approximately 110 tack±20 tack, in other words between 90 and 130 tack.

In one advantageous variation of the present invention, the tack values of the "n" inks to be applied successively to the same side of the same web 11; 11' vary expediently such that the tack values decrease successively from ink to ink. This preferably occurs below a maximum limit of 140 tack, but advantageously within the maximum limits or intervals stated above for the respective conditions.

The values which have been indicated here for tack are determined using a Tack-o-Scope, available from the Testprint Company, under the corresponding recommended parameters. In this case: Sample quantity 500 mm$^3$, without pre-tempering of the ink, distribution 30 sec. at 50 m/min, then 2 min. measuring time at speed to be tested, at the end of 2 min, the value is read out as the result.

The tack of the ink has a relatively low dependence upon web speed, with its increase, preferably at 25° C. and 350 m/min, amounting to a maximum of 0.10 tack/(n/min), and especially a maximum of 0.08 tack/(n/min), again measured using the Tack-o-Scope. However, in one advantageous variation, the increase at the stated point of 25° C. and 350 m/min, is positive and greater than zero, and is especially at least 0.02 tack/(n/min). The result is that a potentially negative increase in the dependence of the tack upon temperature is counteracted. If the printing couple becomes heated, as the speed of production increases, and if the tack decreases as a result of the increase in temperature, it will simultaneously increase due to the increase in speed.

The term "mean value" or "averaged" is preferably understood here as the arithmetic mean.

Preferably, in the respectively relevant printing couple of the first type of printing unit 02, the same ink is provided for both production modes "C" and "H". Therefore, in switching from one production mode to another production mode, it is not necessary to replace the ink or to change ink fountains. The same ink is provided for both production modes and/or for both of the above-described types of print substrate. With respect to ink delivery systems, it is possible to change the production mode without changing or reversing the supply from the ink tank.

Thus, in one advantageous method of operating the first printing press 01, in a first production mode of the printing press 01, a web 11, having a maximum coating weight of 20 $g/m^2$, and preferably of at most 10 $g/m^2$, for example, and/or with a roughness, according to Parker Print Surf (PPS), of greater than 3.50 μm, and especially of greater than 4.00 μm, is fed through a dry offset printing unit 02, and is printed on both sides in a single color or in a multicolor process. This is accomplished using ink that has a maximum mean tack value of 130 tack for the "n" inks to be applied to one side of a web 11, at 25° C. and a speed of 350 m/min, measured using a Tack-o-scope as described above, and/or using ink that has a mean viscosity value for the "n" inks of at least 120 Pas, and especially of at least 150 Pas, averaged from the respective measured values taken during the above-mentioned time frame, for example, using the Physica device of the Anton Paar Company, at 25° C. and a shear rate of 10 $s^{-1}$.

Figure 2:
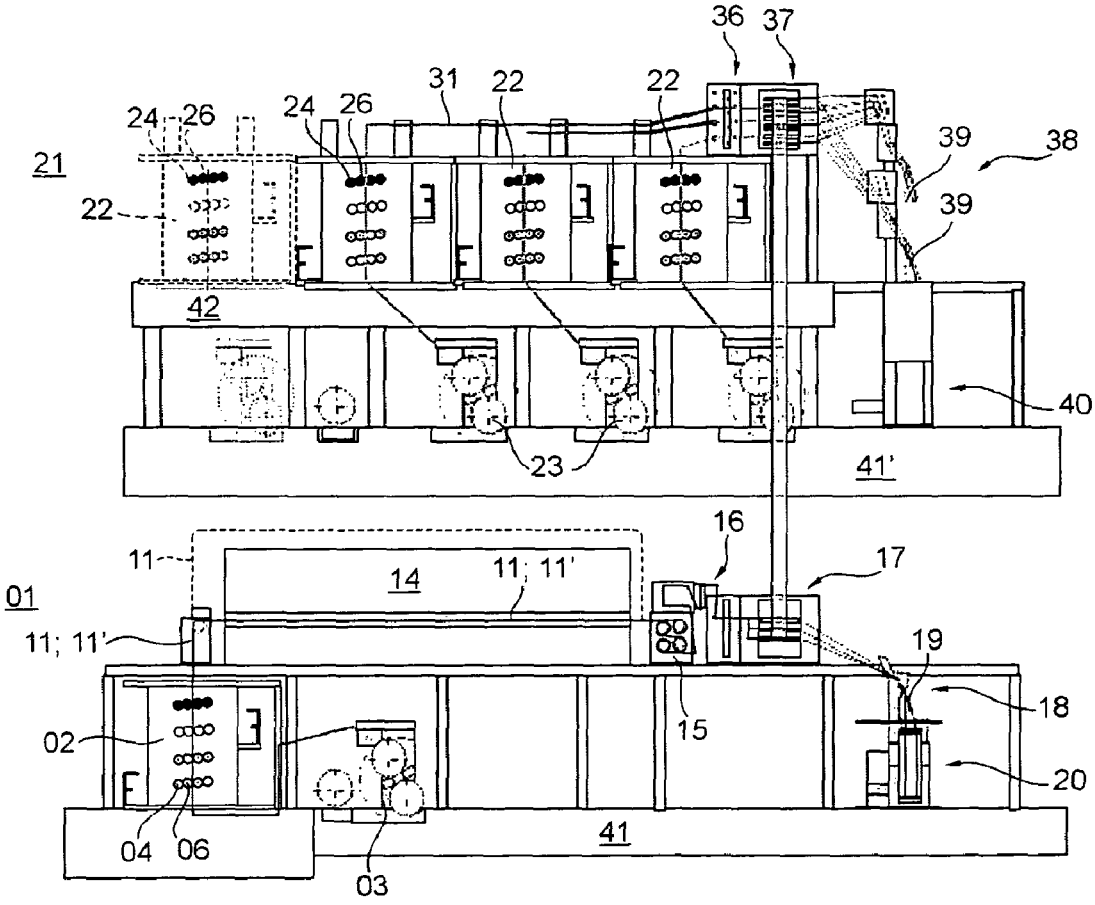
in FIG. 2 a side elevation view of a printing press system in accordance with FIG. 1.

Following printing in this first production mode, for example, a new web of print substrate 11', or web 11', which is different from the first web 11, is fed through the printing unit 02, for example, and is then fed into the dryer 14 which is situate downstream of printing unit 02, as seen in FIGS. 1 and 2. This new print substrate has a significantly higher coating weight and/or a lower roughness than the previously printed web 11. For example, it may have a coating weight of more than 20 $g/m^2$ and/or a maximum roughness, according to Parker Print Surf (PPS), of 3.50 μm. Without changing the ink, this web 11', which is referred to as a heatset web, that is now fed in to the printing unit 02, and is printed on both sides in a single or multicolor process using the same ink that was used in the first production mode.

Figure 11:
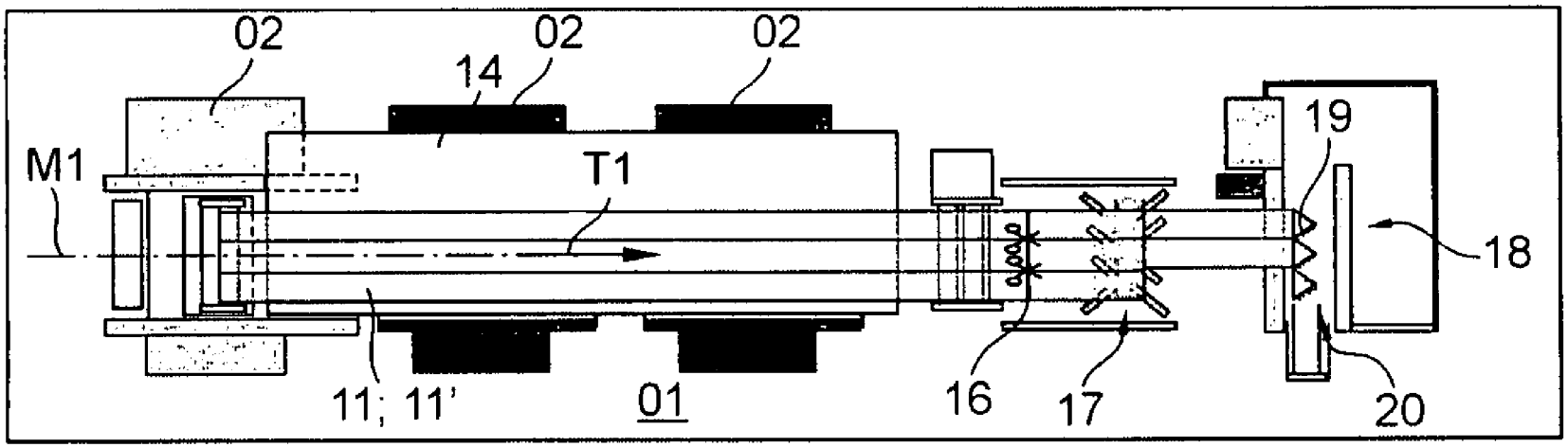

In one advantageous embodiment of the present invention, the printing press 01 has a plurality of printing units 02, at least one of which is configured and/or which is operable in the manner described above. One or more webs 11' or partial webs 11.1'; 11.2'; 11.3' that have been printed in a printing unit 02 operating in heatset mode, as is depicted in FIG. 11, outside left, and which has been fed through a dryer 14, can then be processed on the same former assembly 18, together with webs 11 or with partial webs that have been printed in one or in several printing units 02 of the same press line and which are operating in coldset mode, without subsequent drying, to produce a single product, in a production mode "M" referred to as "mixed production". A press line of this type is represented, by way of example, in FIG. 11, in which a plurality of printing units 02, as described above, are provided. In this embodiment of a printing press line, all of the first type of printing units 02 are preferably the same in configuration, typically as dry offset printing units 02, described above, and preferably all are, or will be operated using the same ink in both coldset and heatset mode. Based upon specific printing requirements, all of the first type of printing units 02 can then be operated in coldset mode. Or in mixed production, for example, one or more of the first type of printing units 02 can be operated in heatset mode, with dryer 14 and optionally with a different paper quality, while other printing units 02 are operated in coldset mode. The printing press line 01 could also have at least one printing unit 02 of this first type, and especially one dry offset printing unit 02, and could also have a plurality of wet offset printing units.

In the case of mixed production, a web 11' that has been printed in heatset mode and which has been fed through the dryer 14, or one or more partial webs, that have been cut in a longitudinal cutting device 16, can be further processed on a fold former 19, together with one or more partial webs or webs that have been printed, without drying, in coldset mode. In this case, coldset and/or heatset partial webs can also be shifted to a different alignment by the use of a turning device 17.

As has been discussed above, even viewed alone, the first printing press 01 already offers significant advantages, in terms of a wide product range at low cost. However, particular advantages result when, in addition to the first printing press 01, the second printing press 21 is also provided, thereby making it possible to process one or more webs 11; 11' or partial webs 11.1; 11.2; 11.3; 11.1'; 11.2'; 11.3' that have been printed in the first printing press 01, together with substrate web 31, or webs 31, or partial webs 31.1; 31.2; 31.3 that have been printed in the second printing press 21 to produce a product in a production mode "M" referred to as "mixed production".

In the schematic top plan view of FIG. 1, and in the vertically offset side elevation view of FIG. 2, a printing press system is shown, which, in addition to the first printing press 01, that can be or that is operated in dry offset mode, or as a dry offset press 01, also comprises the second printing press 21, which is preferably a newspaper printing press 21. The second printing press 21 has a plurality of printing units 22 of the second type in a second machine alignment M2. The second machine alignment M2 of the second printing press 21 extends at the level of a plane of symmetry which divides the printing couple cylinders 24; 26 of the second printing unit 22 in half lengthwise, and which can also be characterized, in this configuration, as a second machine center alignment M2.

The printing units 22 of the second type, and which are situated in the second printing press 21, are also preferably embodied as printing towers 22, as seen in FIG. 2, each having a substantially vertical web path and a plurality of print positions, one above another, for double-sided multicolor printing. Such a printing tower is depicted in more detail in FIG. 5. These second printing units 22 can be embodied or can be operated as wet offset or as dry offset printing units. Particularly if existing systems are being expanded and/or if heretofore more traditional offset techniques of newspaper printing are being employed, the second printing units 22 can advantageously be embodied as wet offset printing units.

In principle, the printing tower 22 can be comprised of a plurality of stacked units, such as, for example H-printing units or satellite printing units. In a first variation, which is advantageous for wet offset printing in terms of its low web fan-out, two nine-cylinder satellite printing units are stacked to form a printing tower 22, for example.

Figure 5:
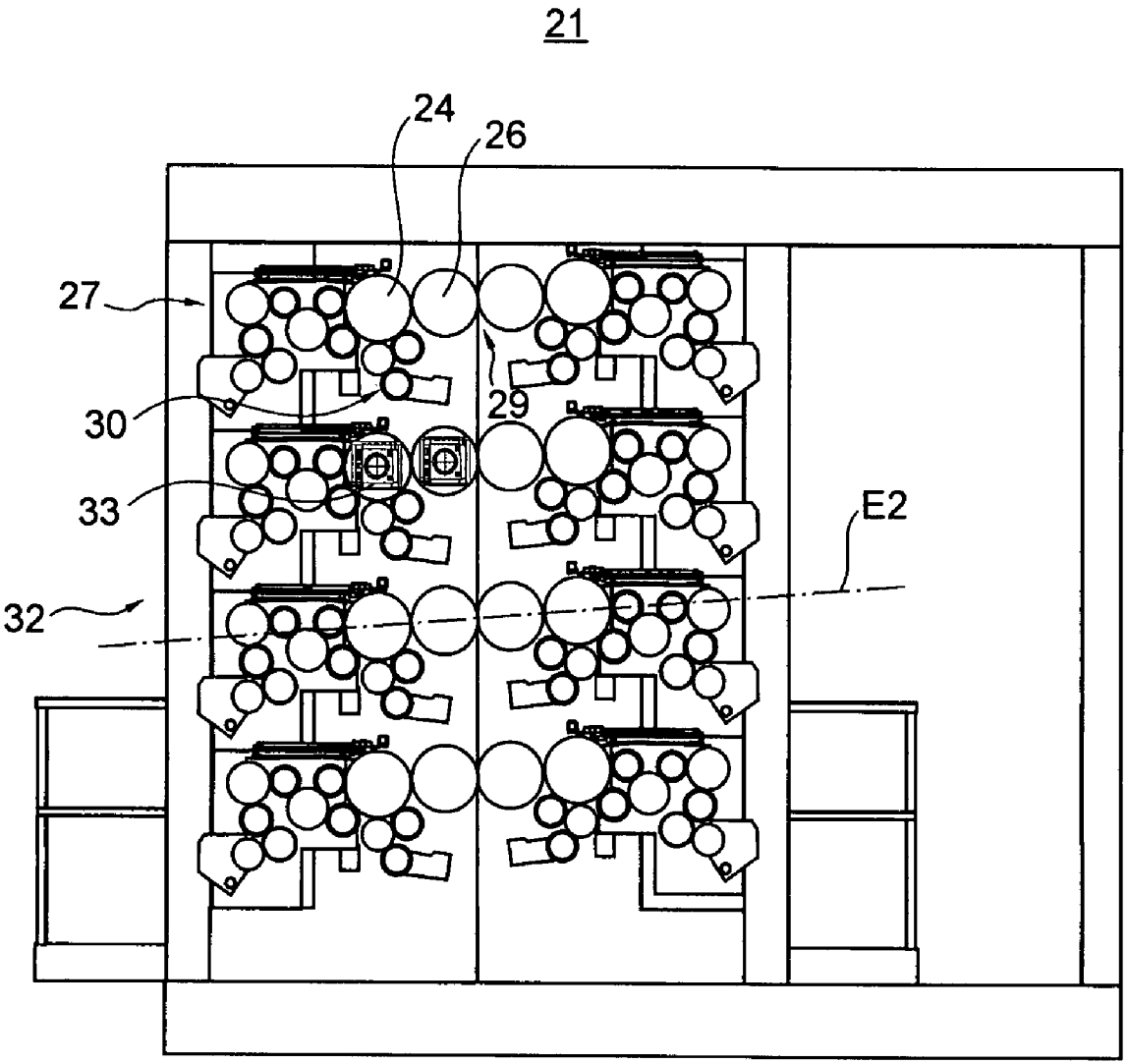
in FIG. 5 a schematic side elevation view of a printing unit of the second printing press.

It is however advantageous, in terms of compactness and/or cost effectiveness, for a plurality of blanket-to-blanket printing units, such as planar bridge, n- or u-units, to be arranged one above another. The blanket-to-blanket printing units each have two printing couples, each comprising printing couple cylinders 24; 26, with cylinder 24 being embodied as a forme cylinder and with cylinder 26 being a transfer cylinder 26. A print position 29, that cooperates with a web of print substrate 31, or web 31, to be printed, is formed between the transfer cylinders 26. The blanket-to-blanket printing units can be stacked one above another in a plurality of frames, or as shown in FIG. 5, can be arranged in the same frame 32. In the configuration shown in FIG. 5, four, preferably planar, blanket-to-blanket printing units are arranged one above another in a shared side frame. The four printing couple cylinders 24; 26 in each printing unit are preferably arranged such that, in the print-on position of each printing unit, their rotational axes lie substantially within a shared plane E2. This plane E2 is again preferably inclined at from 85° to 70° from vertical, as shown in FIG. 5.

The printing couples of this second printing press 21, or of these second printing units 22, can be embodied as printing couples for wet offset, as shown, or for dry offset. They can thus be embodied with, or without a dampening unit. In printing units 22, which are embodied as printing units 22 for wet offset, or in other words, wet offset printing units 22, a dampening unit 30 is provided in the corresponding printing couple, in addition to the provision of an inking unit 27.

In one advantageous embodiment of the present invention, the printing couple cylinders 24; 26 are mounted individually in bearings 33, configured, for example, as linear bearings 33, which linear bearings 33 are shown here, by way of example, on a printing couple, as described in reference to the first printing unit 02, and which are preferably adjustable via power controls. For further details regarding adjustment, the direction of adjustment, and the like, please refer to the discussion presented above in connection with the linear bearings 13 of FIG. 3.

In one advantageous embodiment of the printing unit 22, that printing unit 22 is also configured to be functionally separable, as described above in reference to the separable printing unit 02. This separation may be, for purposes of repair and maintenance, as opposed to for purposes of disassembly or dismantlement.

In the machine alignment M2 of the second printing press 21, a superstructure, having at least one turning device 37 and having, if the printing press 21 is multiple-width in configuration, a longitudinal cutting device 36, is provided. The turning device 37 is configured such that a web 11; 11' or a partial web 11.*x*; 11.*x'*, which is entering from the printing unit 02 of the first type or from the first printing press 01, can be turned 90° into alignment with a web 31 or with a partial web 31.*y* of the second printing press 21, and can be guided over a former assembly 38, which is arranged in the machine alignment M2, for example, and which includes one or more fold formers 39, and can be directed to a shared folding unit 40. In other words, in a mixed production mode "M," the turning device 37 of the second printing press can divert a web 11; 11' or a partial web 11.*x* from the first printing press 01, and which is traveling in the direction of transport T3, through 90° and into a direction of transport T2, which, as shown in FIG. 1, is parallel to the machine alignment M2 of the second printing press 21. This web or partial web can then be fed to the former assembly 38 of the second printing press 21, which is also arranged in the machine alignment M2 of the second printing press 21, for example. A web 11; 11' or a partial web 11.1; 11.2; 11.3; 11.1'; 11.2'; 11.3' that has been transferred from the first printing press 01 to the second printing press 21, is also referred to here as a hybrid web 11; 11' or a hybrid partial web 11.1; 11.2; 11.3; 11.1'; 11.2'; 11.3'. If the two printing presses 01; 21 are parallel to one another, a web 11; 11' that has been printed in the first printing unit 02 is first turned 90° from a direction parallel to the machine plane M1 into the direction of transport T3, for the purpose of transfer.

In addition, to or rather than a "heatset"/"coldset" differentiation between the two types of printing units, these two types of printing units 02; 22 or printing presses 01; 21 can also differ from one another in that the two types of printing units 02; 22 have different maximum effective printing lengths and/or have different circumferences of the imaging printing couple cylinders 04; 24, such as, for example, of the forme cylinders 04; 24. In other words, these forme cylinders 04; 24 of the first and second printing presses 01; 21, respectively, can be configured each having a length and/or a circumference that corresponds to a different number of printed pages of a single format, such as, for example, to newspaper pages in broadsheet format, or that supports the corresponding number of printed pages on the forme cylinder 04; 24. For example, a printing unit 02 or 22 of one type can be embodied with printing couple cylinders, either 04 or 24, having a width of four printed pages, and especially four newspaper pages, or "double-width", and with at least the forme cylinder, either 04 or 24, having a circumference that corresponds to the length of two printed pages or "double-circumference", and especially corresponding to two newspaper pages in a "4/2" configuration. The printing unit 22 or 02 of the other type can be embodied in a 4 length/1 circumference of at least the forme cylinder 24 or 04 configuration, in a 2/2-configuration, "single-width" and "double-circumference", or a 6/2-configuration, "triple-width and double-circumference". In a single-circumference configuration, a printing couple cylinder 06 or 26, such as, for example, a transfer cylinder 06; 26, that cooperates with the "single-circumference" forme cylinder 04 or 24, can also be double circumference in configuration. In principle, one printing press 01; 21 can be embodied as one of the configurations 2/1 "single-width" and "single circumference", 2/2 "single-width" and "double circumference", 4/1 "double-width" and "single circumference", 4/2 "double-width" and "double circumference", 6/1 "triple-width" and "single circumference", 6/2 "triple-width" and "double circumference". The other printing press 21 or 01 will be embodied as one of these configurations, but in a configuration which is different from the first. A wider, such as, for example, a triple-width, printing unit 22 6/1 or 6/2 configuration can also be provided with a narrower printing unit 02 of the first type, for example having a single-width or a double circumference. In general terms, in an x/y configuration, the forme cylinder 04; 24 of the relevant printing unit 02; 22 supports a number "x" of print images, or a number of printing formes, such as printing plates, each with one print image, in the relevant format, such as tabloid format or newspaper format, and especially in broadsheet format in newspaper format, side by side in the longitudinal direction. It also supports a number "y" of corresponding print images in the circumferential direction on its circumference. In this case, an n-width printing couple can accommodate $2 \cdot n = x$ print pages side by side, for example.

In choosing the embodiment of the printing press 01 or 21 in terms of the differentiation in circumference, single-circumference or double-circumference configuration, a single-circumference configuration, such as, for example a 2/1, 4/1 or 6/1 configuration offers advantages with respect to the printing formes that must be changed with a change in production and/or with respect to the page jump in the product to be produced and/or with respect to the machine height. However, a double-circumference configuration such as, for example, a 2/2, 4/2 or 6/2 configuration can offer advantages in terms of a maximum product thickness which can be produced in collect production. In terms of the difference in the number of printed pages, which are arranged side by side in the longitudinal direction of the forme cylinder, product thickness to be achieved and/or efficiency are also viewed as criteria in the decision process.

If, for example, only a small number of special layers are required in the hybrid product, and if this first printing press 01 is required to produce only products of narrow scope in unit production, for example, a single-width configuration may be sufficient. Thus, if the two types of printing units 02; 22 are configured with different widths and/or different circumferences, a specific adjustment to the requirements of a specific product spectrum can be made.

In the case of a triple-width, such as a 6/1 or a 6/2 configuration of one of the printing units 02; 22 or of one of the printing presses 01; 21, each transfer cylinder 06; 26, which is six printed pages wide, can support one printing blanket that is continuous over the entire length of the cylinder, two printing blankets that are each three pages wide, or three printing blankets that are each two pages wide. These printing blankets are preferably metal printing blankets having a dimensionally stable carrier plate, such as, for example, a metal plate, and a flexible and/or compressible coating. The preferred embodiment comprising two rubber blankets, each being three pages in width, and arranged side by side in the longitudinal direction, and the preferred embodiment comprising a single rubber blanket that is continuous over the entire length, are both advantageous in terms of increased variability, such as, for example, with pop-up production or variable web width. The single, continuous rubber blanket is especially advantageous for printing units 02 of the first printing press 01, in terms of enabling different product formats. Each of the rubber blankets can cover the entire transfer cylinder circumference and, if multiple blankets are provided in the longitudinal direction, can be offset circumferentially in relation to one another. With regard to product variability, at least in printing units 02 of the first printing press 01, and, if applicable, in both printing presses 01; 21, it is also advantageous for the forme cylinder grooves, for use in securing printing formes over the length of the forme cylinder 04; 24, to be embodied as continuous cylinder grooves.

Figure 6:
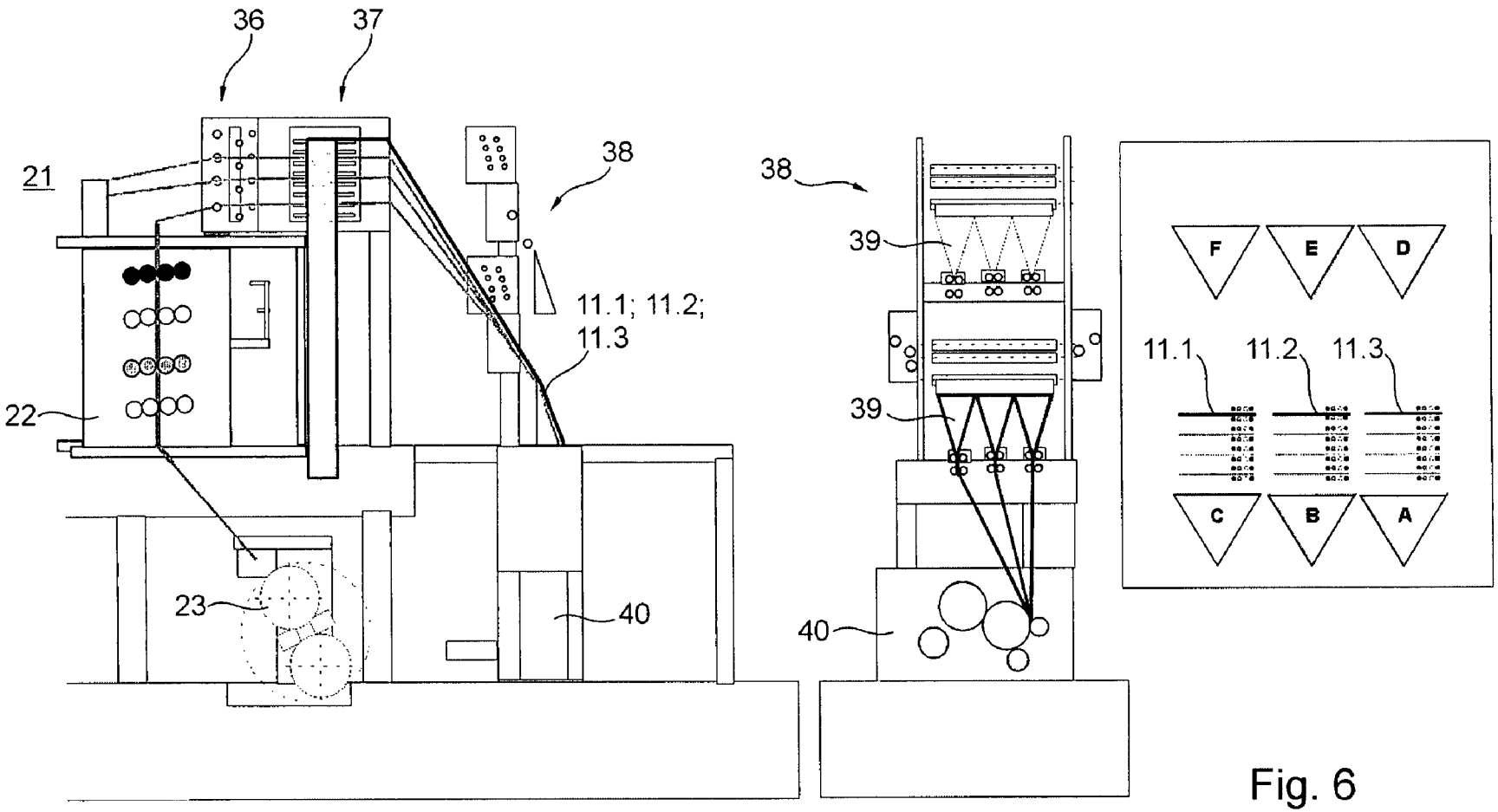
in FIG. 6 a schematic side elevation view of the printing press system and showing a first example of the web lead in the printing press system.
Figure 7:
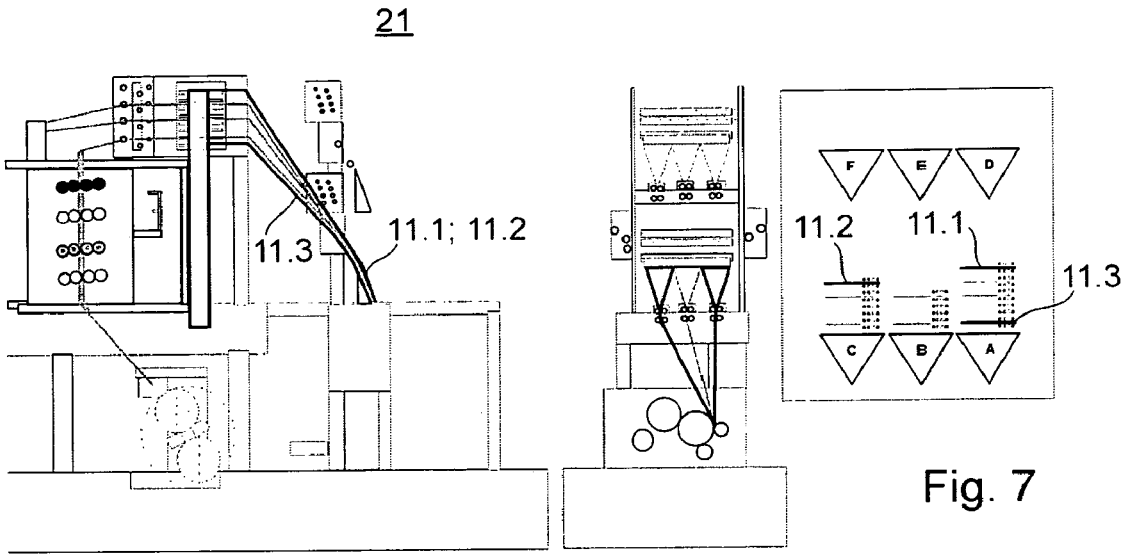
in FIG. 7 a second example of the web lead in the printing press system.
Figure 8:
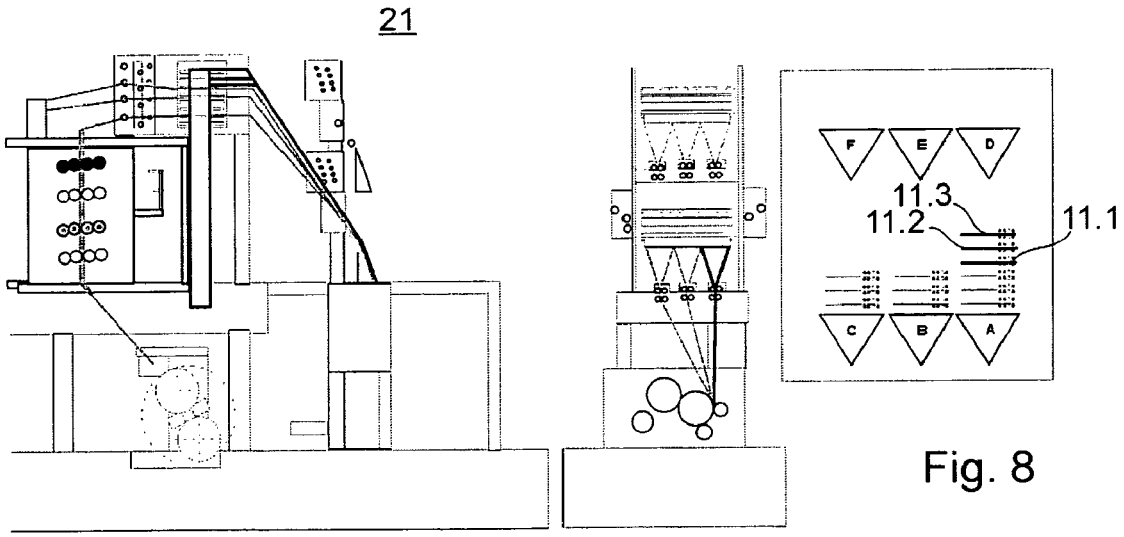
in FIG. 8 a third example of the web lead in the printing press system.
Figure 9:
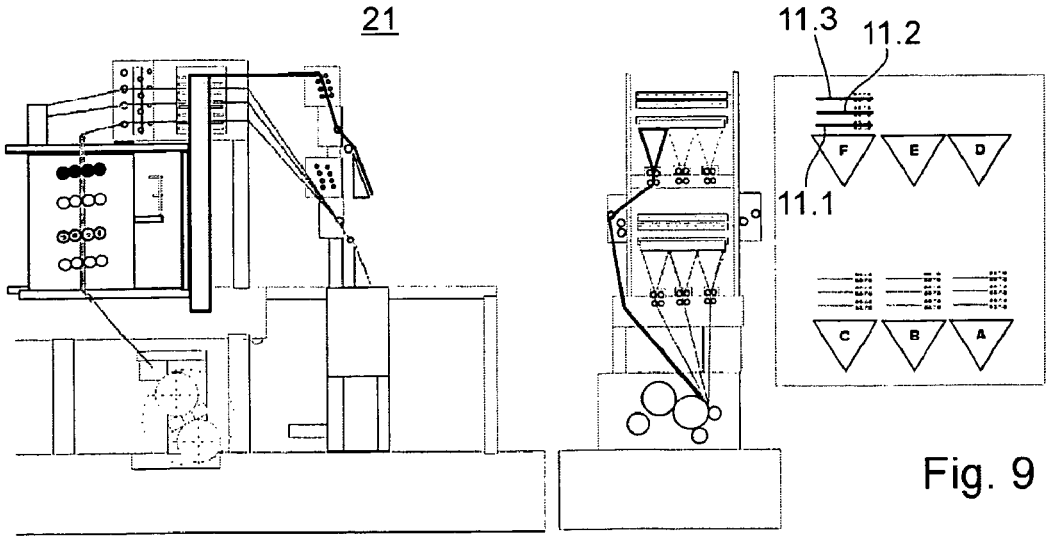
in FIG. 9 a fourth example of the web lead in the printing press system.
Figure 10:
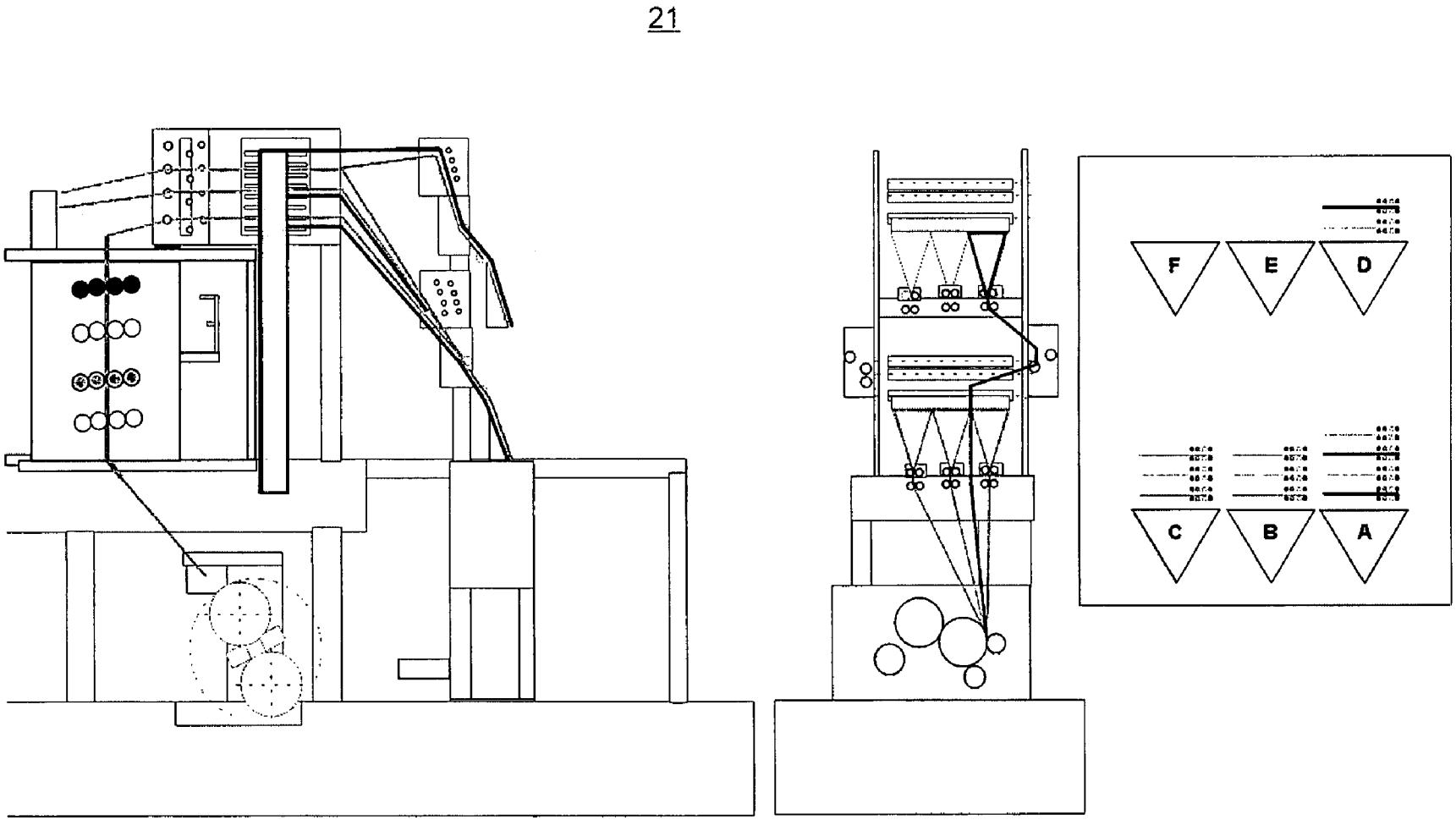
in FIG. 10 a fifth example of the web lead in the printing press system; and in FIG. 11 a schematic top elevation view of a preferred embodiment of a printing press comprising multiple printing units.

In the present advantageous example, both printing presses 01; 21 are embodied as triple-width and double-circumference printing presses. The second printing press 21, which is preferably embodied as a newspaper printing press 21, has a former assembly 38 with two groups of three fold formers 39 each, with the two groups of three fold formers each being arranged one above another, as seen in FIG. 6. In FIG. 6 through 10, examples of the range of product forms are depicted, with each of the drawings showing, in three parts, a partial side view of the second printing press 21 with incoming "hybrid, or partial web"/"hybrid or partial webs" 11; 11.1; 11.2; 11.3; a front view of the former assembly 38, and a former lead diagram. The partial webs 11.1; 11.2; 11.3, resulting from the first printing press 01, are represented by bold lines. As the drawings show, by feeding in the hybrid or partial webs 11; 11.1; 11.2; 11.3, the hybrid or partial webs 11; 11.1; 11.2; 11.3 that have been printed in heatset mode, for example, can be mixed among the partial webs 31; 31.1; 31.2; 31.3 that have been printed in coldset mode, at the widest range of levels. In FIG. 6, for example, a hybrid partial web 11.1; 11.2; 11.3 is added to each of three ribbon bundles from the second printing press 21 as the uppermost layer, which uppermost layer will later form the outer layer of the individual longitudinally folded ribbon section. In FIG. 7, the innermost and outermost layers of a longitudinally folded ribbon section and the outer layer of another ribbon section are formed by a hybrid partial web 11.1; 11.2; 11.3. In FIG. 8, the outer layers of a ribbon section are formed by the available hybrid partial webs 11.1; 11.2; 11.3, which are here depicted as three such hybrid partial webs. In FIG. 9, only one ribbon section is formed by the hybrid partial webs 11.1; 11.2; 11.3, which single ribbon is then combined with other ribbon sections in the folding unit. In the example of FIG. 10, four ribbon sections are produced. In one of the ribbon sections, an outer layer is produced. In another of the ribbon sections, an intermediate layer and the inner layer are produced from hybrid partial webs 11.1; 11.2; 11.3. In addition to the variations for web lead and for product configuration shown here, many other possibilities exist.

In the above depicted and described examples, the two printing presses 01; 21 are arranged side by side such that their machine alignments M1; M2 extend parallel to one another. In this case, the rotational axes of the printing couple cylinders 04; 06 of the first printing press 01 extend parallel to the rotational axes of the printing couple cylinders 24; 26 of the second printing press 21.

In an advantageous embodiment of the printing press system in accordance with the present invention and which is not shown here, the two printing presses 01; 21 are not arranged side by side. Instead, they are arranged one in front of another in the same machine alignment. The two former assemblies, or at least one of the two former assemblies, can then be arranged between the printing units 02; 22 of the two presses.

In-another advantageous embodiment of the printing press system, which is also not specifically shown here, the two printing presses 01; 21, and especially at least a first printing unit 02 with the allocated dryer 14 and a plurality of second printing units 22, are arranged angled in relation to one another such that their machine alignments M1; M2 extend perpendicular to one another. The rotational axes of the printing couple cylinders 04; 6 of the first printing press 01 therefore extend orthogonally in relation to the rotational axes of the printing couple cylinders 24; 26 of the second printing press 21. In this case, it is not necessary to divert the hybrid, partial webs 11; 11.1; 11.2; 11.3 from the first printing press, because they are already arranged to be fed into the second printing press 21 in a linear path.

The two printing presses 01; 21 can each be embodied with both presses in an in-line configuration, in which roll changer 13; 23 and printing unit 02; 22 and, if applicable, folding unit 20; 40 are in substantially the same base plane. Or, they can be embodied with both presses in a platform configuration, wherein the printing unit 02; 22 and, if applicable, the folding unit are in a plane above the plane of the roll changer, for example on a so-called "platform" and with the base plane or the platform then being shared by the two printing presses 01; 21.

As is apparent from the various drawing figures, one advantageous embodiment of the present invention consists wherein the heatset printing press 01 is arranged in an in-line configuration, with the roll changer 03 and the printing unit 02 in substantially the same plane 41, for example a base plane 41, which, if applicable, may be configured with slight offsets. The other printing press 21, such as, for example, the coldset printing press 21, is arranged in a platform configuration with the roll changers 23 in a first plane 41', such as, for example, a base plane 41', and with the printing units 22 arranged in a plane 42 that is located above the roll changers 23, for example on a platform 42. In the illustrated further improvement shown in FIG. 1, the folding unit 40 of the coldset printing press 21 is also arranged in the base plane 41'. In an advantageous embodiment, the two base planes 41; 41' of the two printing presses 01; 21 can be the same, and can be provided, if applicable, with slight offsets.

In FIGS. 1 and 2, a printing press system is shown, in which the first printing press 01 has only one first printing unit 02 and a dryer 14, and the second printing press 21 has a section comprising a group of adjacent second printing units 22 and a former assembly 38. However, the first printing press 01 can also have a plurality of first printing units 02 and a plurality of dryers 14 and/or one dryer 14 that is suitable for a plurality of webs 11. This first printing press 01 can be connected to a second printing press 21 comprising one or more sections, in such a way that at least one hybrid, partial web 11; 11.1; 11.2; 11.3 can be transferred to the superstructure of the second printing press 21. Conversely, however, the first printing press 01 can also have only one printing unit 02 and one dryer 14, and can be connected to a second printing press 21, that comprises several sections, in such a way that at least one hybrid, partial web 11; 11.1; 11.2; 11.3 can be transferred to the superstructure of the second printing press 21.

In one advantageous embodiment of the printing press system in accordance with the present invention, the first type of printing units 02 of the first printing press 01, which can be operated in dry offset mode, are identical in structure, with the exception of the dampening units 30. In this case, for example, second printing units 22 can be used as first printing units 02, however the dampening units 30 are not installed in these or are at least deactivated during mixed production "M" or hybrid operation.

The printing press system makes it possible for the first printing press 01, in the separate production option "G", to be operated in either heatset mode "H" or in coldset mode "C" using dry offset. At the same time, the second printing press 21, such as, for example, in an embodiment that uses wet offset, will be, or is operated in coldset mode "C," with each printing press 01; 21 exclusively using its own former assembly 18; 38 for production. In the mixed production "M" option, the first printing press 01 can be operated in either heatset mode "H" or coldset mode "C", using the dry offset process, while at the same time the second printing press 21, such as, for example, in an embodiment that uses wet offset, will be, or is operated in coldset mode "C." In this case, however, at least one partial web 11; 11.1; 11.2; 11.3 that has been printed in the first printing press 01, and especially in heatset mode, will be, or is fed, together with at least one partial web 31; 31.1; 31.2; 31.3 from the second printing press 21, to a shared former assembly 38; 18, and especially to that former assembly 38 of the second printing press 21.

The term "same ink", as is used in connection with two differently operated printing units, means that the same type of ink, having substantially the same composition, is used. Of course, the inks will differ with respect to their pigments, depending upon whether they are black, yellow, cyan or magenta inks. However, this is not the meaning that is intended here. For example, with regard to a certain specific color, a specific color tone, such as the color black, precisely the same ink is used in both production modes coldset and heatset and/or in both of the differently operated dry offset printing units 02; 22.

In the aforementioned production modes, the web 11 that is printed in coldset is a roll of material, for example, containing a first type of paper, for example a newsprint paper, in the roll changer 03 which is situated upstream of the coldset printing unit. The web 11' that is printed in heatset, with a subsequent drying process, is a roll of material, for example, containing a second type of paper that is different from the first type.

While preferred embodiments of a printing press, a method of operating a printing press, a printing press system and a method for operating the printing press system, all in accordance with the present invention, have been set forth fully and completely hereinabove, it will be apparent to one of skill in the art that various changes in, for example, specific drives for the various press components, arrangements for supplying web rolls to the roll chargers, types of dampening fluids used and the like could be made without departing from the true spirit and scope of the subject invention which is accordingly to be limited only by the following claims.

What is claimed is:

1. A printing press comprising:

at least one dry offset printing unit operating without a dampening unit and having a first machine alignment;

a dryer associated with said at least one dry offset printing unit;

means for feeding a first web through said at least one dry offset printing unit, and without a subsequent drying process, in a first production mode of said at least one dry offset printing unit;

means for feeding a second web through said at least one dry offset printing unit and through said dryer in a second production mode of said at least one dry offset printing unit;

an inking unit of said at least one dry offset printing unit and containing ink, said ink being usable in both of said first and second production modes of said printing press; and a second printing unit including a former assembly and having a second machine alignment parallel to, and spaced from said first machine alignment, and with said at least one dry offset printing unit and said second printing unit being separated laterally from each other, said second web printed in said at least one dry offset printing unit and fed through said dryer in said second production mode of said at least one dry offset printing unit being fed, together with a web printed in said second printing unit and without a subsequent drying process, to said former assembly in a mixed production mode of said printing press.

2. The printing press of claim 1 wherein said ink has substantially the same composition in said first and second production modes of said printing press.

3. The printing press of claim 1 further including means for deactivating said dryer and wherein in said first production mode, said first web is selectively one of fed around said dryer and is fed through said dryer which is deactivated.

4. The printing press of claim 1 wherein said first web has at least one of a maximum coating weight of 20 $g/m^2$ and a roughness PPS of more than 3.50 μm.

5. The printing press of claim 1 wherein said second web has at least one of a coating weight of more than 10 $g/m^2$ and a maximum roughness PPS of 3.5 μm.

6. The printing press of claim 1 wherein said ink has at least one of a maximum tack of 130, as determined using a Tack-o-Scope at 25° C. and at a web speed of 350 m/min, and a viscosity of at least 120 Pas using a Physica measuring device at 25° C. and a shear rate of 10 $s^{-1}$.

7. The printing press of claim 1 wherein said inking unit is a short inking unit.

8. The printing press of claim 7 wherein said short inking unit includes a temperature controlled anilox roller.

9. The printing press of claim 1 further including first and second printing couple cylinders in said at least one dry offset printing unit and further including means for mounting said printing couple cylinders for adjustment in relation to each other and further including power-controlled actuators usable to adjust said printing couple cylinders in relation to each other.

10. The printing press of claim 9 wherein, in said first production mode and in said second production mode, first and second pressure levels, which are different from each other, are supplied to said power-controlled actuators for adjustment of print-on settings of said printing couple cylinders.

11. The printing unit of claim 1 wherein said at least one dry offset printing unit is embodied as a printing tower and includes a plurality of blanket-to-blanket printing units arranged above each other.

12. The printing press system of claim 1 wherein said second printing unit is a web offset printing unit.

13. The printing press system of claim 1 wherein said at least one dry offset printing unit is selectively operable in one of a heatset production mode and a coldset production mode.

14. The printing press of claim 1 further including a first roll changer for said at least one dry offset printing press and which first roll changer is located in said first machine alignment with said at least one dry offset printing unit and said dryer, and further wherein said second printing press is in one of a platform and a floor assembly structure.

15. A method of operating a printing press including:

providing a dry offset printing unit operable without a dampening agent and including an ink supply;

providing a web dryer;

locating said web dryer downstream, in a direction of web travel, and in a first machine alignment of said dry offset printing unit;

operating said dry offset printing unit a first production mode;

supplying a first web to said dry offset printing unit in said first production mode;

operating said dry offset printing unit in a second production mode;

supplying a second web, to said dry offset printing unit in said second production mode;

directing said second web through said dryer;

maintaining said ink supply to said dry offset printing unit the same in both of said first production mode and said second production mode;

providing a second printing unit, including a former, and having a second machine alignment parallel to, and spaced from said first machine alignment and with said at least one dry offset printing unit and said second printing unit being separated laterally from each other;

printing a web in said second printing unit;

feeding said second web printed in said dry offset printing unit and directed to said dryer to said former assembly; and combining said second web and said web printed in said second printing unit and without subsequent drying with said second web at said former assembly in a mixed mode of production of said printing press.

16. The method of claim 15 further including providing said second web having one of a higher coating weight and a lower roughness than said first web.

17. The method of claim 15 further including using printing inks having substantially the same composition in said dry offset printing unit in both of said first and second production modes of said printing press.

18. The method of operating a printing press system of claim 15 further including:

providing a first web having at least one of a coating weight of more than 20 g/m$^2$ and a maximum roughness PPS of 3.5 μm;

feeding said first web through said at least one first printing unit without an application of dampening agent; and transferring said first web to said former assembly.

19. The method of claim 18 further including operating said second printing press in a coldset production mode.

* * * * *